US006378720B1

(12) United States Patent
Santa Cruz et al.

(10) Patent No.: US 6,378,720 B1
(45) Date of Patent: Apr. 30, 2002

(54) COMBINATION TRASH RECEPTACLE AND STEP STOOL

(76) Inventors: Cathy D. Santa Cruz, 7630 Tholl Dr., Reno, NV (US) 89506; Stan Gittelman, P.O. Box 2106, Carson City, NV (US) 89721

( * ) Notice: Subject to any disclaimer, the term of this patent is extended or adjusted under 35 U.S.C. 154(b) by 0 days.

(21) Appl. No.: 09/912,507

(22) Filed: Jul. 23, 2001

(51) Int. Cl.[7] ..... B65F 1/14
(52) U.S. Cl. ..... 220/495.06; 182/91; 220/908
(58) Field of Search ..... 220/908, 720, 220/890, 495.06, 495.07, 23.86, 23.83, 23.87, 23.91; 182/91, 156, 129, 33

(56) References Cited

U.S. PATENT DOCUMENTS 2,658,640 A * 11/1953 Bayles ..... 182/129
4,846,304 A * 7/1989 Rasmussen ..... 182/129
5,967,255 A * 10/1999 Young ..... 182/91

* cited by examiner

*Primary Examiner*—Stephen Castellano

(57) ABSTRACT

The present invention provides a new and unusual combination trash receptacle and step stool, which is portable, compact, safe, and includes a novel storage compartment and garbage bag installation means.

9 Claims, 2 Drawing Sheets

COMBINATION TRASH RECEPTACLE AND STEP STOOL

FIELD OF THE INVENTION

This invention relates to trash containers in general but more particularly pertains to a trash receptacle having a step stool therewith, and when the stool is not in use it can be conveniently folded into a retracted position, yet it is easily accessible when needed for use. Also, the receptacle includes unique retrieval means for inserting a garbage bag therein.

BACKGROUND OF THE INVENTION

In the past, there have been many types of trash containers and various types of step stools. However, nowhere in the prior art did the applicants find a combination of both, which would be most useful and novel as this allows a user quick access to the step stool as well as the trash container.

It is well known that most people position their trash containers in a convenient location for easy disposal, such as within the kitchen area, etc. Most often in such locations, the user has a need for use of a step stool which would allow for quick access to items located in high cabinets, or the like. Therefore, the applicants contend there is a great need for a trash container that includes an easy access step stool therewith, with the step stool being conveniently retracted when not in use yet easily accessible when needed.

SUMMARY OF THE INVENTION

It is therefore an object of the present invention to provide a combination trash receptacle and step stool which is of a shape and size so as to be conveniently positioned within an area of user choice, and allows the user to easily dispose of trash as well as provides a step stool for easy access to items when needed.

It is another object of the present invention to provide a combination trash receptacle and step stool which is economical to produce and manufacture from any suitable material of engineering choice, such as plastic, wood, aluminum, etc. and which is of a sufficient strength to support an adult when standing thereon.

Yet another object of the present invention is to provide a combination trash receptacle and step stool that includes a lid having a non-slip treated surface, so as to eliminate the possibility of the user slipping and having an accident.

Also a further object of the present invention is to provide a combination trash receptacle and step stool which includes various attachment means for removably attaching items of user choice onto the container, such as dish-towels, dust-rags, a dust-pan, a whisk broom, or the like.

Still another object of the present invention is to provide a combination trash receptacle and step stool which includes a storage compartment for containment of typical plastic garbage bags, which can be either stored individually, on a roll, or within a box or the like.

A very important object of the present invention is to provide a combination trash receptacle and step stool having internal and external access to the above noted compartment. As the internal access allows the user to easily grasp one of the garbage bags from the inside of the container and position it for use, all in one step that is simple, easy, convenient and clean, and the external access allows the user to easily replace the garbage bags when needed.

Yet another object of the present invention is to provide a combination trash receptacle and step stool having handles and locking casters which allow the user to easily move and position the trash receptacle into the desired location, and secure it in place.

Still another object of the present invention is to provide a combination trash receptacle and step stool which may include an odor control insert therewith, and a compartment for containment thereof.

Other objects and advantages will be seen when taken into consideration with the following drawings and specification.

DETAILED DESCRIPTION OF THE DRAWINGS

Figure 1:
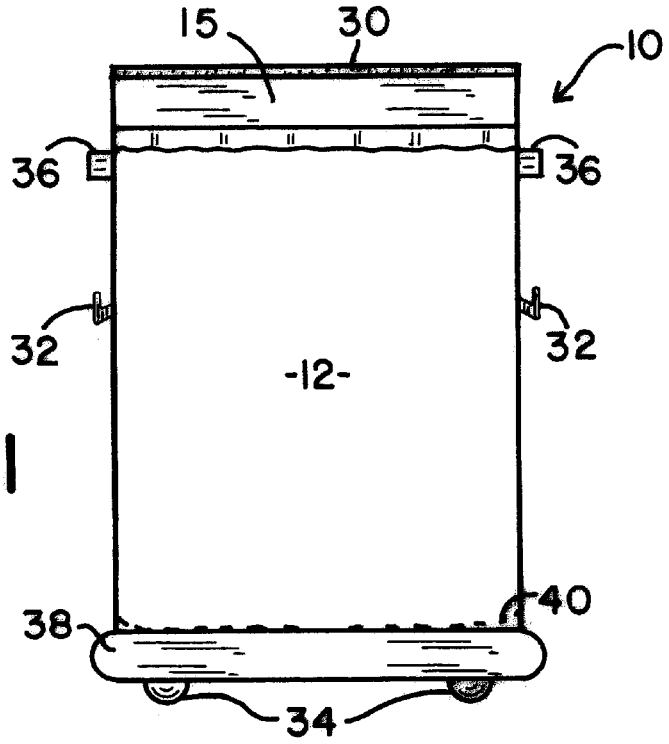
FIG. 1 is substantially a front side view of the preferred embodiment for the present invention.

Referring now in detail to the drawings wherein like characters refer to like elements throughout the various views. It is to be understood the present invention as depicted herein is only exemplary of one suitable embodiment, as the invention can be made in any suitable shape or size or from any suitable material of engineering choice, such as plastic, rubber, wood, aluminum, metal, etc.

As depicted throughout the views 1–4, the present invention is substantially a combination trash receptacle and step stool represented by overview (10), with the receptacle (12) being substantially formed from a front wall, a rear wall, a right side wall, a left side wall a bottom, and a lid (15). It is to be understood each wall with bottom and lid in combination form an internal compartment (17) which is used for containment of trash (not shown).

With the step stool (14) being substantially formed from at least one step (16) having at least one support leg (18) which is hingedly pivotably attached by hinge means (20).

It is to be understood that multiple steps (16), and multiple support legs (18) may be used as well as any other suitable type of hinge means (20) of engineering choice.

Figure 2:
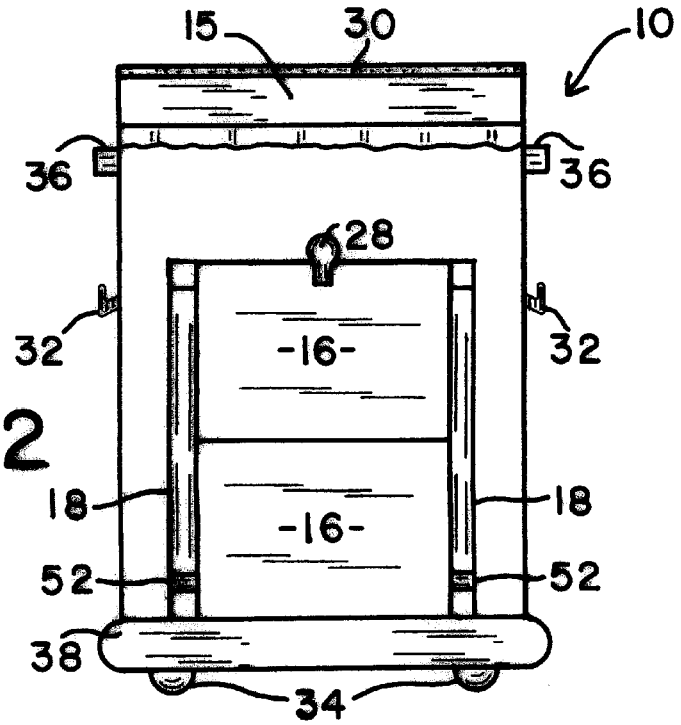
FIG. 2 is substantially a back side view of the preferred embodiment for the present invention.
Figure 3:
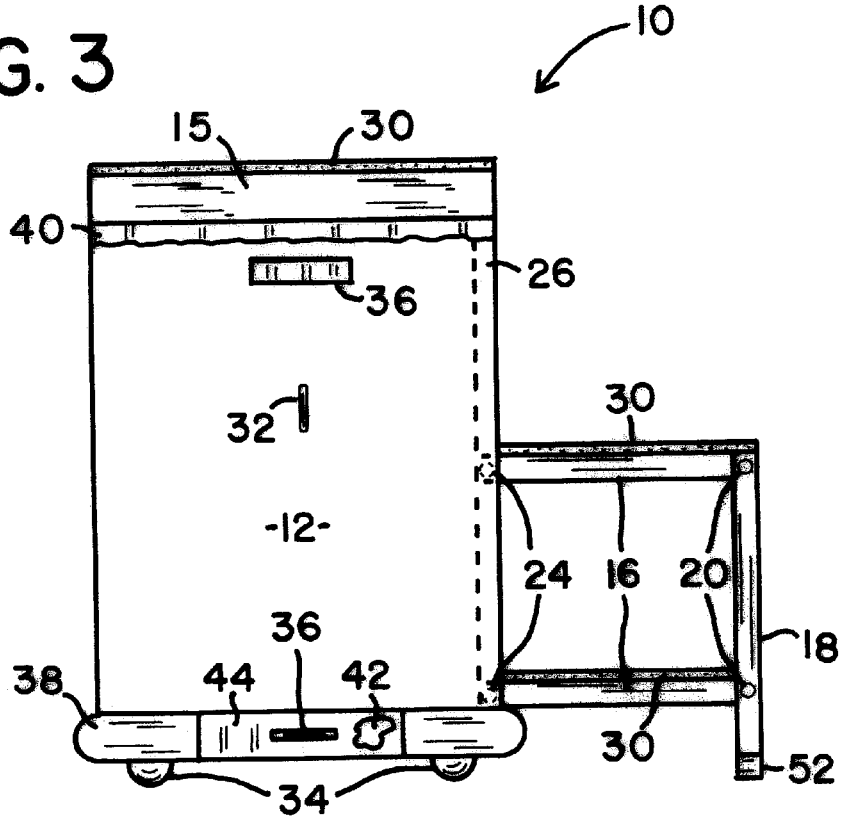
FIG. 3 is substantially a side view of the preferred embodiment for the present invention.
Figure 4:
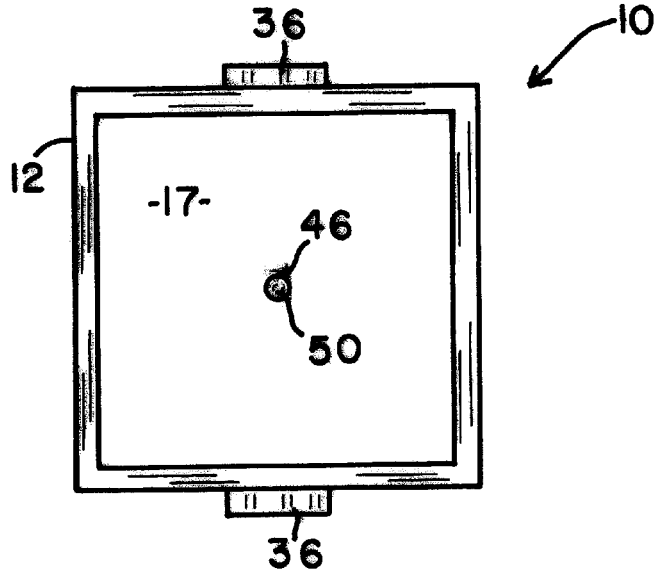
FIG. 4 is substantially a top view of the preferred embodiment for the present invention with the lid removed.

It can now be seen that step stool (14) has a retracted closed position as depicted in FIG. 2 and detracted open position as depicted in FIG. 3.

It is to be further understood that various attachment means may be used for attaching step stool (14) onto receptacle (12). Thus the following is only exemplary of one possible attachment means. Wherein step (16) is pivotably attached to an attachment bracket (22) by suitable pivot means such as pivot pin (24), with attachment bracket (22) being suitably fixedly mounted onto receptacle (12) at the desired location. For example, at least one of the side walls either the right side or left side, includes a recessed cavity (26) and attachment bracket (22) is fixedly secured therein, such as by screws (not shown) or the like. Also, the last noted side wall further includes a locking mechanism (28) for securing step stool (14) onto the noted side wall when step stool (14) is in its retracted closed position. Recessed cavity (26) is of a shape and size to receive step stool (14) therein when step stool (14) is in the noted retracted closed position. Whereby, it can clearly be seen when step stool (14) is in its retracted closed position it is held in a flush manner within recessed cavity (26).

It is to be further understood lid (15) may be of any suitable lid construction of engineering choice, for example lid (15) may be hingedly attached and spring loaded so as to automatically open when pressed upon. Or the lid (15) may be simply frictionally engaged, etc.

However, the applicants feel it is very important that lid (15), step (16), and support leg (18) each include a non-slip surface. Again, any means for providing a non-slip surface can be implemented, such as a sprayed on coating, a roughened irregular surface, etc. Or as the applicants prefer, a rubberized material (30), is most suitable for lid (15) and step (16), and rubberized foot pads (52) are most suitable for support leg (18).

Other features are to include hooks (32) which can be used for multiple purposes of user choice, such as for hanging a dust rag, a bucket, a whisk broom and dust pan, towels, or the like.

Also, another important feature is to provide locking casters (34). Again any suitable type of locking casters may be used according to engineering choice. Thus, the general construction and properties of the casters (34) are not described herein as there are numerous types of suitable casters in the known prior art.

Yet another feature may be to include handles (36) which allow the user to easily move receptacle (12) from one location to another. Again, handles of any type may be used, such as recessed, protruding, rectangular, or even of ergonomic design, etc.

A very important and novel feature is to include an internal concealed compartment (38) which can be used for containment of any article of user choice, such as either individual garbage bags (40), rolled garbage bags, or a box of garbage bags, etc. and concealed compartment (38) includes an opening (42) with reusable closure means, such as an access door (44) which allows for easy replacement of either individual garbage bags (40), rolled garbage bags, or a box of garbage bags. Most importantly, the concealed compartment (38) includes a hole (46) which is in open communication with internal compartment (17) of trash receptacle (12). Whereby, one of the garbage bags (40) can be easily grasped by the user and simply pulled up through hole (46) and then positioned into place within trash receptacle (12). Also, if desired hole (46) may further include a reusable closure means of engineering choice, such as a plug (50) which allows the user to easily seal off hole (46), such as when a garbage bag is not in use.

It can now be seen we have herein provided a new and novel combination trash receptacle and step stool which is portable, compact, is of simple construction, and includes unique features heretofore not taught within the known prior art.

Although the invention has been herein shown and described in what is conceived to be the most practical and preferred embodiment, it is recognized that departures may be made there from within the scope and spirit of the invention, which is not to be limited to the details disclosed herein but is to be accorded to the fill scope of the claims so as to embrace any and all equivalent devices and apparatuses.

Having described the invention what we claim as new and wish to secure by Letters Patent is:

1. A trash receptacle and step stool in combination comprising: a front wall; a rear wall; a right side wall; a left side wall; a bottom; a lid; and a step stool; each said wall with said bottom and said lid in combination form an internal compartment, said step stool being formed from at least one step having at least one hingedly pivotably attached support leg, said step stool having a retracted closed position and a detracted open position, said step being pivotably attached to an attachment bracket, at least one said side wall having a recessed cavity for receiving said step stool therein when said step stool is in said retracted closed position, said at least one said side wall having a locking mechanism for securing said step stool onto said at least one said side wall when said step stool is in said retracted closed position, and said attachment bracket being fixedly secured within said recessed cavity, whereby:

said step stool when in said retracted closed position is held in a flush manner within said recessed cavity.

2. The trash receptacle and step stool of claim 1 further includes said lid and said step each having a non-slip surface.

3. The trash receptacle and step stool of claim 1 further includes hooks.

4. The trash receptacle and step stool of claim 1 further includes locking casters.

5. The trash receptacle and step stool of claim 1 further includes handles.

6. The trash receptacle and step stool of claim 1 further includes an internal concealed compartment for containment of either individual garbage bags, rolled garbage bags, or a box of garbage bags.

7. The trash receptacle and step stool of claim 6 further includes said internal concealed compartment having an opening with closure means for easy replacement of either said garbage bags, rolled garbage bags, or a box of garbage bags.

8. The trash receptacle and step stool of claim 6 further includes said internal concealed compartment having a hole which is in open communication with said internal compartment of said trash receptacle, whereby;

one of said garbage bags can be easily grasped and pulled through said hole and then positioned into place within said trash receptacle.

9. The trash receptacle and step stool of claim 8 further includes said hole having reusable closure means.

* * * * *